US006264214B1

(12) United States Patent
Bonaventure et al.

(10) Patent No.: US 6,264,214 B1
(45) Date of Patent: Jul. 24, 2001

(54) SPORT BOOT HAVING A PARTIALLY COVERED RIGID FRAME

(75) Inventors: Laurent Bonaventure, Cran Genrier; Bruno Sirvain, Sales, both of (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/282,211

(22) Filed: Mar. 31, 1999

(30) Foreign Application Priority Data

Apr. 3, 1998 (FR) ..... 98 04343

(51) Int. Cl.[7] ..... A63C 17/00; A43B 5/00

(52) U.S. Cl. ..... 280/11.221; 280/11.3; 36/115; 36/118.2

(58) Field of Search ..... 280/11.221, 11.3, 280/11.27, 11.225, 11.28, 11.31; 36/115, 54, 120, 50.1, 45, 91, 118.2, 117

(56) References Cited

U.S. PATENT DOCUMENTS

| | | | | |
|---|---|---|---|---|
| 3,807,062 | | 4/1974 | Spier | 36/2.5 |
| 4,385,456 | | 5/1983 | Livernois et al. | 36/115 |
| 4,907,354 | * | 3/1990 | Benoit et al. | 36/93 |
| 4,969,278 | * | 11/1990 | Ottieri | 36/117 |
| 5,092,614 | * | 3/1992 | Malewicz | 280/11.22 |
| 5,253,436 | * | 10/1993 | Mattiuzzo et al. | 36/117 |
| 5,331,752 | | 7/1994 | Johnson et al. | 36/115 |
| 5,437,466 | | 8/1995 | Meibock et al. | 280/11.22 |
| 5,499,461 | | 3/1996 | Danezin et al. | 36/117 |
| 5,678,833 | * | 10/1997 | Olson et al. | 280/11.22 |
| 5,722,450 | * | 5/1998 | Ellis et al. | 280/11.22 |
| 5,755,450 | * | 5/1998 | Ellis et al. | 280/11.22 |
| 5,815,952 | | 10/1998 | Bobrowicz | 36/117.3 |
| 5,819,440 | | 10/1998 | Okajima | 36/117.1 |
| 5,848,796 | * | 12/1998 | Meibock et al. | 280/11.22 |
| 5,875,570 | * | 3/1999 | Sartor | 36/118.2 |
| 5,878,513 | * | 3/1999 | Annovi et al. | 36/115 |
| 5,901,469 | | 5/1999 | Saillet | 36/118.2 |
| 5,926,976 | * | 7/1999 | Cretinon et al. | 36/50.1 |
| 5,926,979 | * | 7/1999 | Borel | 36/115 |
| 6,009,639 | * | 1/2000 | Donnadieu et al. | 36/54 |
| 6,027,127 | * | 2/2000 | Olson et al. | 280/11.22 |
| 6,076,285 | * | 6/2000 | Caeran et al. | 36/118.2 |
| 6,079,129 | * | 6/2000 | Bourdeau et al. | 36/118.2 |

FOREIGN PATENT DOCUMENTS

| | | |
|---|---|---|
| 2110328 | 5/1995 | (CA) . |
| 0740908 | 11/1996 | (EP) . |
| 0753267 | 1/1997 | (EP) . |
| 0780062 | 6/1997 | (EP) . |
| 0786211 | 7/1997 | (EP) . |
| 2759553 | 8/1998 | (FR) . |
| WO 95/15094 | 6/1995 | (WO) . |
| WO 97/32496 | 9/1997 | (WO) . |
| WO 97/48458 | 12/1997 | (WO) . |

* cited by examiner

*Primary Examiner*—Lanna Mai
*Assistant Examiner*—Hau Phan
(74) *Attorney, Agent, or Firm*—Greenblum & Bernstein, P.L.C.

(57) ABSTRACT

A boot adapted to the practice of skating and a method of manufacturing such boot, the boot including a shell base equipped with a rigid sole adapted to be attached on the frame of a skate and a heel reinforcement part, and a flexible liner that is positioned inside the shell base including of a padded upper part surrounding the foot and at least one outer pocket portion. The shell base according to the invention has a rigid collar portion that extends the heel reinforcement and the pocket portion at least partially covers the collar portion so as to ensure at least partially the retention of the flexible liner in the shell base. The invention relates to a boot structure encompassing the essential functions of foot retention and controlled flexibility, and whose assembly is made easier.

31 Claims, 5 Drawing Sheets

SPORT BOOT HAVING A PARTIALLY COVERED RIGID FRAME

BACKGROUND OF THE INVENTION

1. Field of the Invention

The invention is related to a sports boot and, more specifically, a sports boot adapted to the practice of skating, such as an in-line skate or an ice skate. The invention is also related to such a skate, as well as to the method for manufacturing a boot and skate.

2. Description of Background and Relevant Information

There exist several categories of boots intended for skating. Among them, one can find boots with upwardly extending shells having a journalled collar and an inner padded lining. This construction is a derivative of the alpine ski boot. In particular, the shell is made of a relatively rigid plastic material. There are numerous disadvantages to this type of construction. For example, these skates are considered to be "hot" to the wearer and provide little ventilation for the foot. These skates are also considered to be uncomfortable, due to the rigidity of the shell and of the collar that completely surround the foot and the lower part of the leg.

Another known type of construction, as described in U.S. Pat. No. 5,499,461, consists of providing a boot that is formed entirely by a flexible upper, at least partially ventilated, and mounted on a sole base, and to associate thereto discrete rigidifying elements, such as a heel reinforcement and a collar journalled externally on the reinforcement. The advantage of such a construction is that it provides greater flexibility along with maximum comfort and freedom of movement. Such a construction is also better adapted to foot ventilation. However, the rigid outer parts contribute to the lateral retention of the ankle and the lower part of the leg for reasons of stability and safety, while allowing a substantial front/rear bending freedom when skating. Nevertheless, even this type of construction has disadvantages: one of the main drawbacks is the relatively high cost of manufacturing due to the fact that one must design a truly flexible boot structure, and then associate thereto, via appropriate connection means, rigid external reinforcement elements. The design necessitates calling upon the traditional techniques of sewing, gluing, hot forming, "mold" mounting and other techniques used in the manufacture of traditional boots.

Patent application EP-A1-780 062, for example, describes another type of boot that can be adapted to in-line skating and that is a compromise between the upwardly extending shell category made entirely of a rigid plastic material, possibly punched with ventilation holes, and boots with flexible uppers that are partially reinforced with rigid plastic elements. The construction has a rigid outer shell base, a journalled collar attached onto the shell and a liner (or inner shoe) that is housed in the shell.

However, such a construction also has its drawbacks. One of them is that its construction remains a complex and expensive undertaking, and its assembly is delicate. Indeed, the collar has to be mounted rotationally on the shell base after the placement of the liner in the shell base. Then, it must be fixed to the inner padding via additional manual operations such as gluing, sewing, or on-site molding. Another drawback derives from the fact that a part of the flexible covering of the collar is sandwiched between the collar and the shell about a pivot point. This part is therefore subject to repeated friction, leading to the rapid wear and tear of the flexible divider part capable of providing a clearance between the collar and the shell and of quickly deteriorating the aesthetic appearance of the boot.

In addition, there exist numerous variations for skating boots, such as those described in the following documents: U.S. Pat. No. 5,437,466; International Patent Publication No. WO 95/15094; U.S. Pat. Nos. 4,385,456; 5,331,752; 3,807,062; and International Patent Publication NO. WO 97/48458.

French Patent Publication No. 2 759 553, commonly owned with the instant application, is related to a boot having a rigid frame, constituted of at least one rigid sole part and one heel reinforcement, and it includes an upper that is at least partially flexible with a part in the shape of a cover corresponding to the shape of a rigid frame adapted to be threaded onto the rigid frame, the cover being equipped with means for connecting it to the rigid frame. An object of the invention is to provide a boot structure that reconciles the advantages and appearance of a flexible boot with the rigidity and ankle retention advantages of a rigid boot. The present invention proposes improving upon this type of construction. Consequently, French Patent Publication No. 2 759 553, is hereby incorporated by reference thereto in its entirety.

SUMMARY OF THE INVENTION

One of the objects of the instant invention is therefore to propose a boot that is more specifically adapted to the practice of in-line skating, that resolves the problems of stability, foot retention, and transmission of forces without providing too much stiffness, and that retains, at the same time, maximum comfort and ventilation.

Another object of the invention is to propose a boot that provides both good lateral retention as well as relative flexibility in the front/rear direction.

Yet another object is to propose an assembly method between the so-called "supple" or "flexible" elements and the so-called "rigid" or "stiff" elements, ensuring differing and generally opposing functions via simple, efficient, cost-effective and optionally detachable means.

A further object of the invention is to propose a boot construction method that is simple and whose assembly is quick and easy, with or without a minimum of traditional manual repeat operations, such as sewing, gluing, molding, "mold" mounting, or other operations.

Yet another object of the invention is to propose a boot that can be manufactured at low cost but whose technical quality and appearance are at least equal to those products that are currently available.

In order to achieve these objects, as well as others, the invention is related to a boot adapted to the practice of in-line skating, including:

- a rigid shell base equipped with a rigid sole adapted to be attached on the frame of the skate, a heel reinforcement part and a longitudinal opening;
- a flexible liner that is placed in the shell base that has a padded part surrounding the foot and at least one outer pocket portion;
- the shell base has a rigid collar portion that extends the heel reinforcement; and
- the outer pocket portion at least partially covers the collar portion so as to ensure, at least partially, the retention of the flexible liner in the shell base.

The shell base, as well as the collar extending therefrom, participates in the lateral retention of the foot and the ankle in the boot. The flexible liner ensures the careful enveloping and comfort. A structure of this type promotes ventilation by allowing air to enter via the longitudinal opening and air circulation in the space formed between the shell base and the flexible liner.

According to an advantageous characteristic of the invention, the pocket portion only partially covers the shell base such that it leaves at least a substantial part of the heel reinforcement of the shell base free. A structure of this type ensures an optimal enveloping of the top parts of the shell base that are less subject to friction and impacts so as to obtain a good cohesion of the liner/shell base assembly, and the low parts of the shell base that are capable of resisting friction and repeated impacts are left uncovered. Another advantage of the partial covering of the shell base is that it promotes the flexibility of the boot, with respect to a total covering that opposes a more substantial resistance to the bending of the boot. Another advantage is that it allows better air circulation by creating openings in the transition zones between the liner and the shell base with respect to a complete covering. Yet another advantage is that it helps in the lightness of the structure.

According to a preferred characteristic of the invention, the rigid collar portion is integrally or unitarily connected to the shell base.

This frame combining the shell base and the collar to a liner equipped with a pocket is an important characteristic of the invention because it helps to simplify the construction method by limiting the number of elements requiring assembly, and therefore simplifies the assembly. The assembly is also made easier because the integral construction promotes the rigidity of the frame to be covered. Furthermore, the liner pocket ensures a good retention of the liner in the shell base. No further traditional operation, such as sewing, gluing, or other operation, is required to finalize the assembly. As such, the assembly becomes economical because only a minimum number of its technical elements necessitates assembly.

According to another advantageous characteristic of the invention, the outer pocket portion has an opening that is mainly oriented in the direction that facilitates the sliding of the collar portion in the pocket portion during the insertion of the liner in the shell base. Thus, the assembly between the liner and the support portion consisting of the shell base and the collar is made easier. In a preferred embodiment, the pocket opening is oriented mainly downwardly in the direction of the sole.

According to another characteristic of the invention, the liner is detachably mounted in the shell base.

The invention is also related to the method for manufacturing the boot which includes the following:

- providing a flexible liner having a padded upper part and at least one flexible pocket portion equipped with an opening;
- providing a rigid shell base separately from the liner, the shell base forming an open cavity and including a rigid sole, a reinforcement portion and at least one collar portion extending the shell base;
- assembling the flexible liner to the shell base by introducing a part of the liner in the cavity and by threading at least a part of the collar portion through the opening of the flexible pocket portion.

BRIEF DESCRIPTION OF DRAWINGS

The characteristics, advantages and other aspects of the invention that have been mentioned hereinabove, as well as others, will become apparent from the description that follows with reference to the annexed schematic drawings, illustrating a non-restrictive embodiment of the invention, in which.

DETAILED DESCRIPTION OF THE INVENTION

Figure 1:
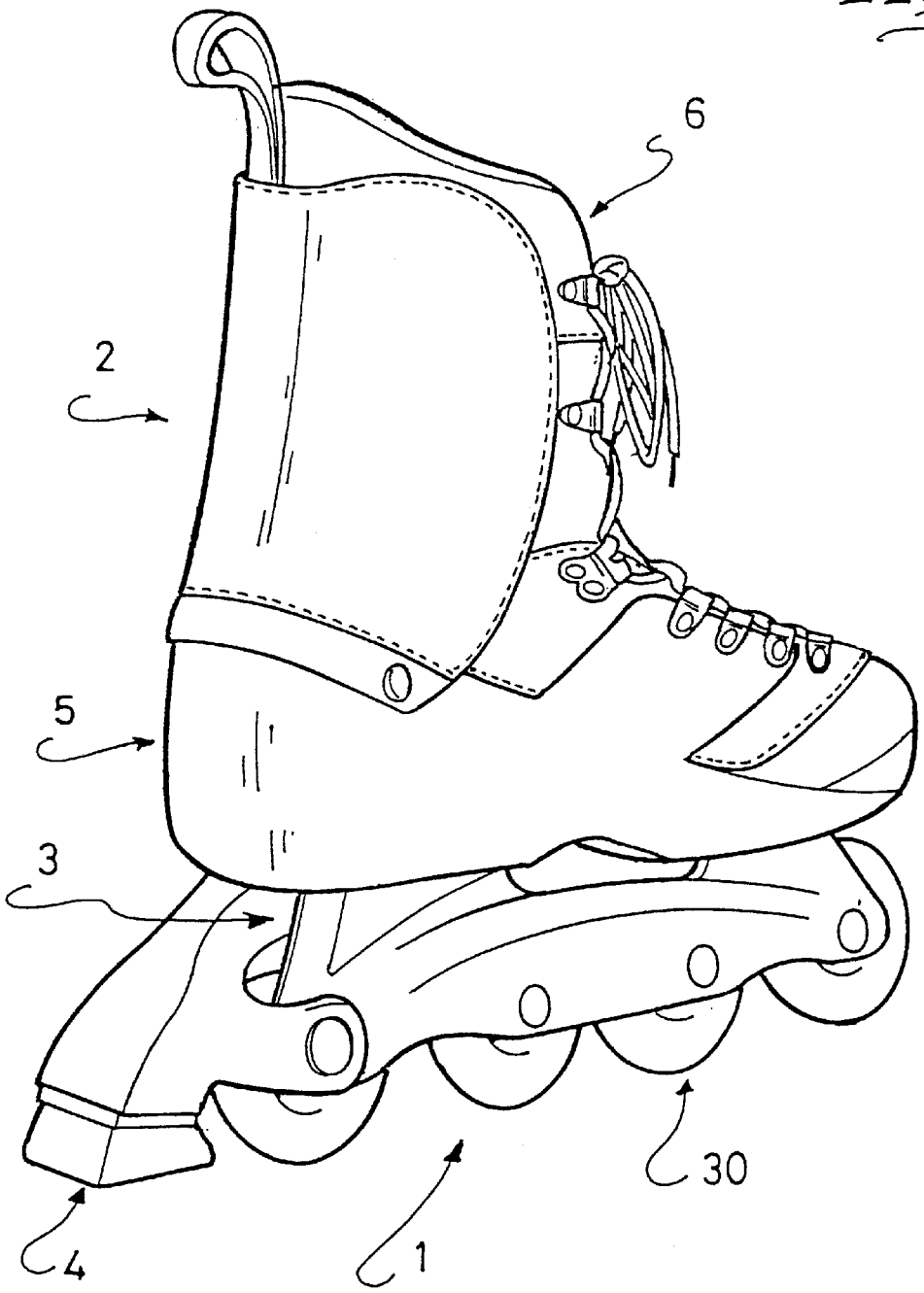
FIG. 1 is rear perspective view of an in-line skate having a boot according to the invention.

With reference to FIG. 1, the in-line skate 1 represented herein includes a boot 2 associated to a frame 3 equipped with a plurality of wheels 30 arranged in an aligned configuration. A braking system 4 can be optionally associated to the skate.

The boot 2, which is the main object of the invention, includes of a shell base 5 whose function is to bring together the essential elements of the frame of the boot that ensure the reinforcement and the retention of the foot and the ankle. As for flexibility and comfort, these arc guaranteed by a liner or inner shoe 6 placed in the shell base 5.

Figure 2:
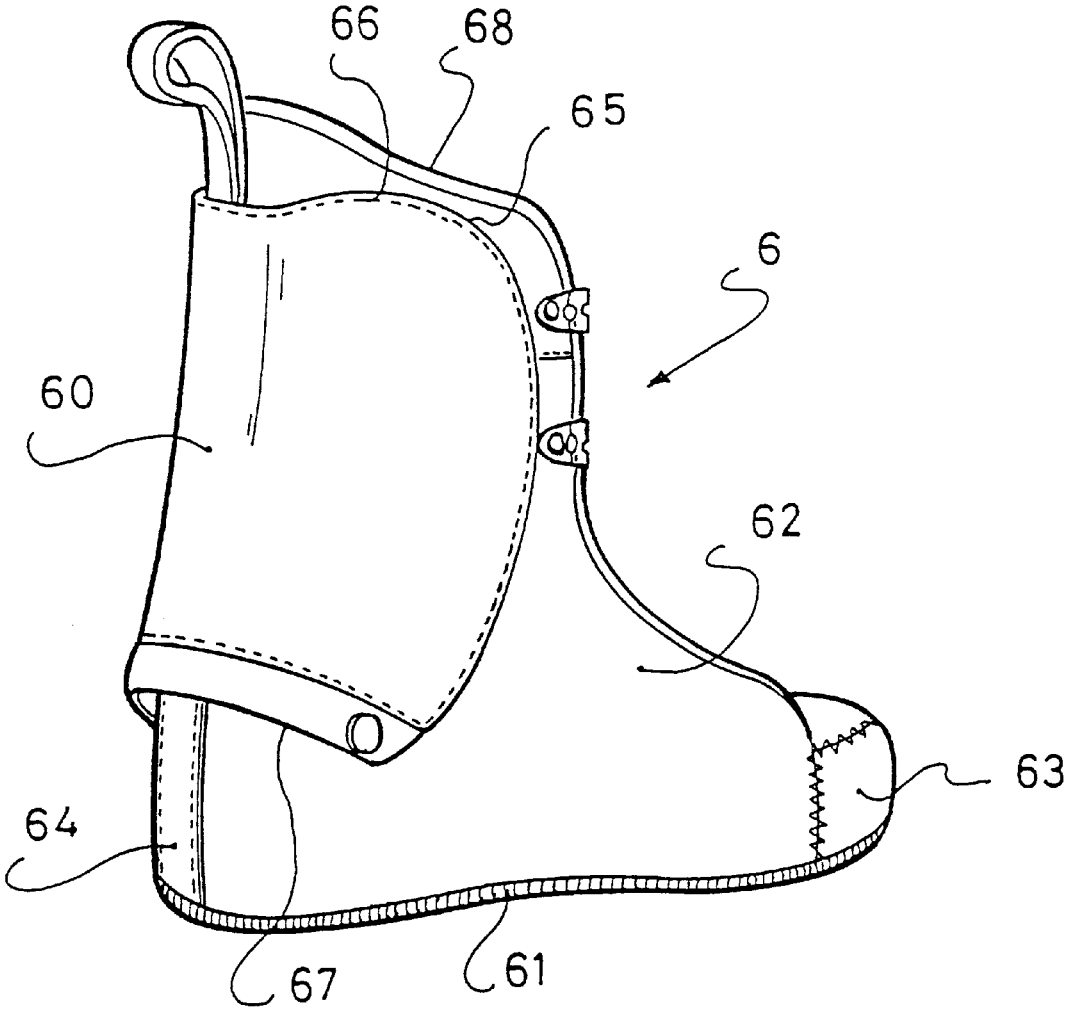
FIG. 2 is a rear perspective view of a liner according to the invention.

FIG. 2 shows the main parts of the liner 6 according to the invention. It includes the actual liner part and a pocket portion 60 attached thereto. The liner has a sole portion 61 connected to a flexible upper portion 62 extending from the toe 63 of the foot to the heel 64, and rising laterally and towards the rear in the direction of the lower part of the leg. The upper is formed of a flexible outer envelope, made from a fabric or flexible synthetic material, and of an inner padding 68. The pocket portion is connected to the flexible upper along a part of its periphery 65 via an appropriate connecting means, such as a stitching 66. A remaining part of the pocket portion is left free and thus includes an opening 67. One of the advantages of such a construction is the fact that the flexible parts ensuring the enveloping and the comfort are assembled on the liner and are therefore dissociated from the frame part, which is made separately and then easily assembled with the liner.

Figure 3:
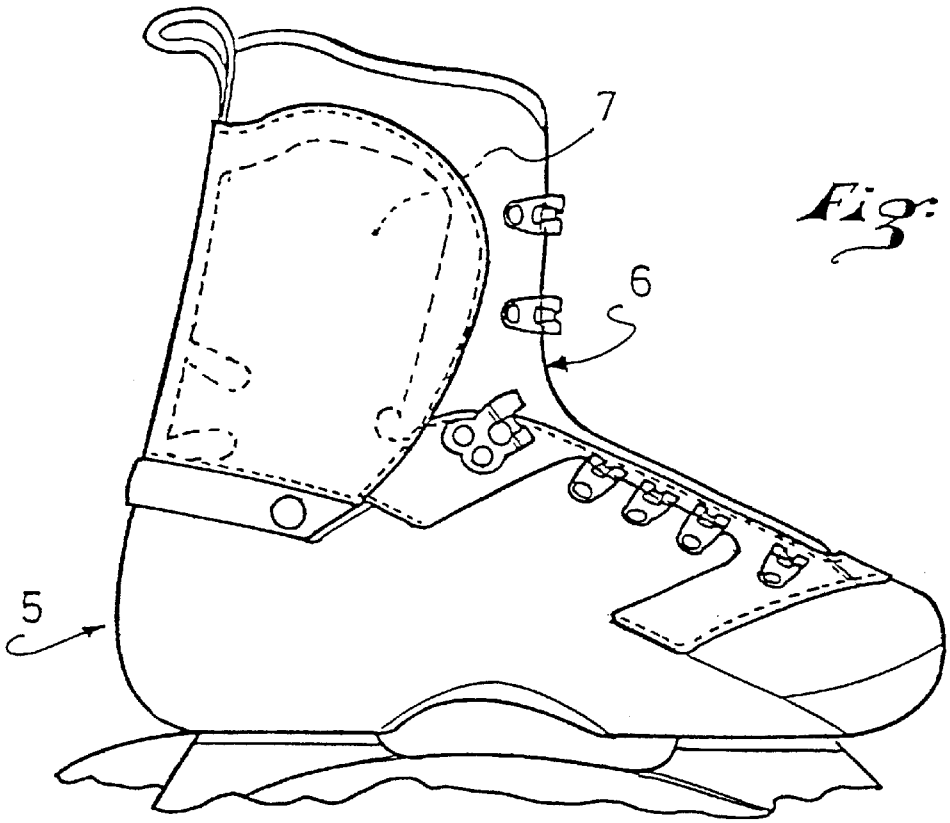
FIG. 3 is a side elevation view of a boot of the invention adapted to a frame of an in-line skate.
Figure 4:
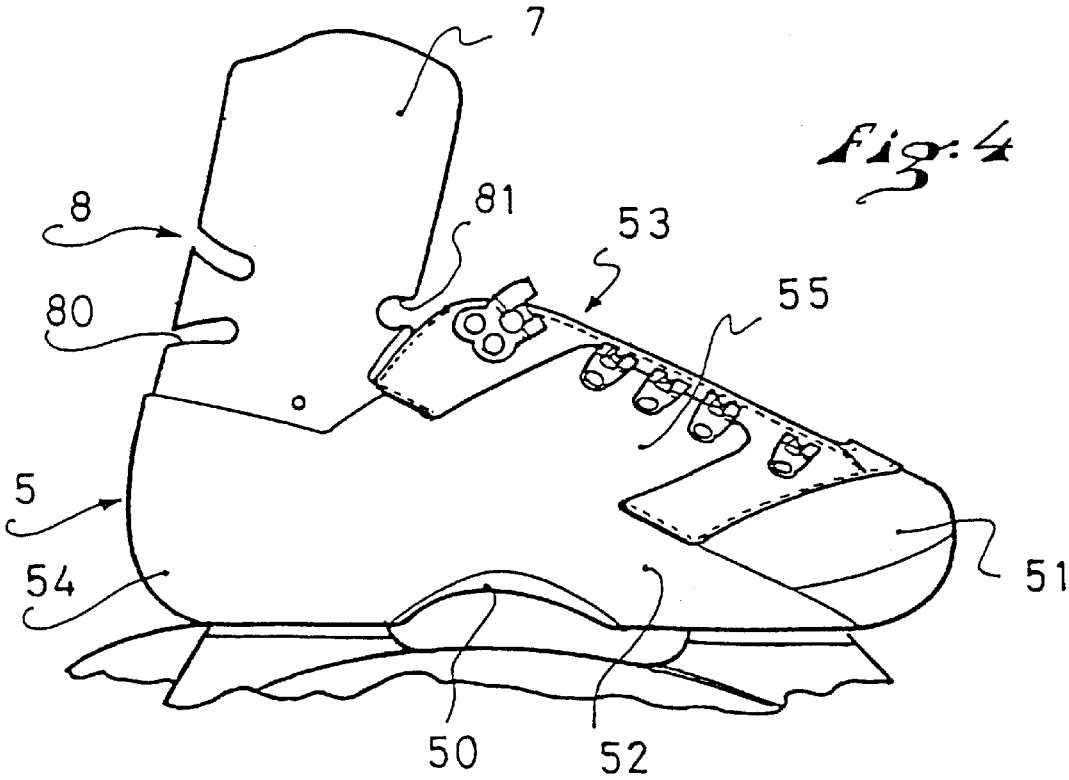
FIG. 4 is a partial side elevation view of the boot according to the invention.
Figure 5:
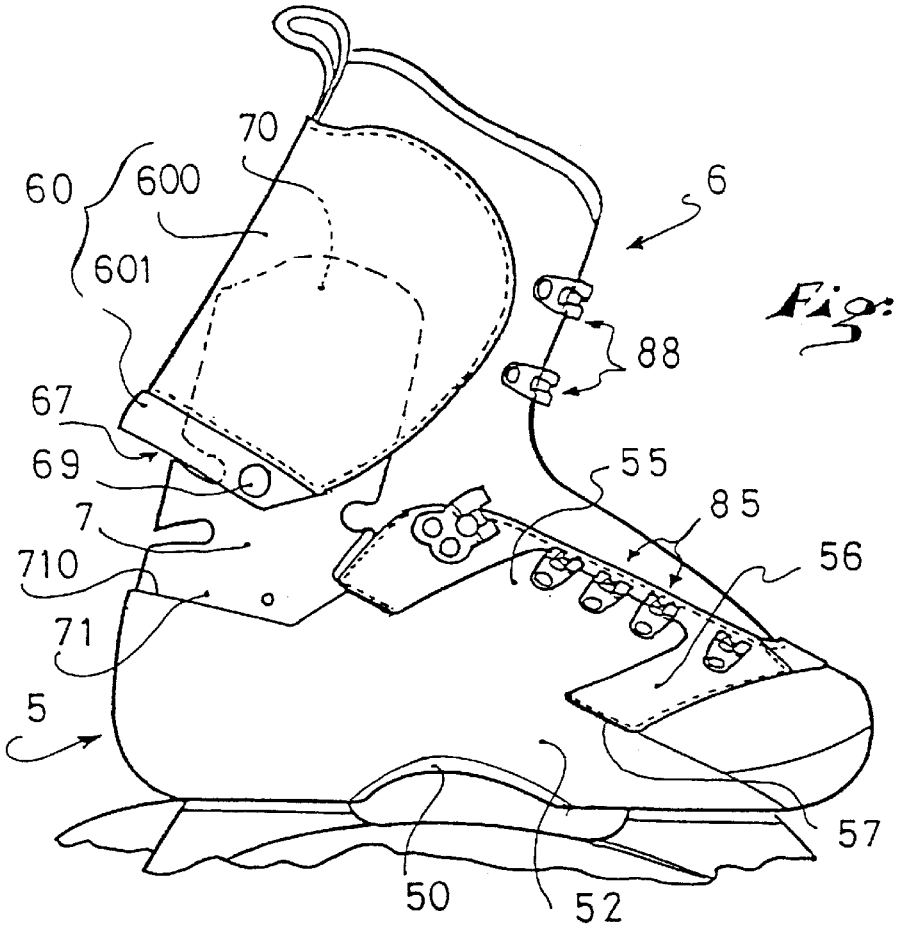
FIG. 5 is a side elevation view illustrating the assembly operation of the boot according to the invention.

With reference to FIGS. 3 through 5, the boot of the invention is formed by a simple assembly of the shell base 5 and the liner 6 after such parts have been manufactured independently. The shell base has a collar portion 7 that ensures the lateral retention of the ankle and the lower part of the leg approximately from tie region of the malleoli. Preferably, the collar portion extends the heel reinforcement portion 54 of the shell base in an integral manner. The term "integral" as used herein denotes that the shell base and the collar portion together from one piece, and are preferably obtained by the molding of a plastic material all in one piece, i.e., a unitary piece of material. However, in some instances, provision can be made for the shell base to be constituted of several elements made separately and attached via connecting members that do not allow the a degree of freedom of movement, such as rivets or screws, for example; this assembly is also considered, at least in terms of its results, as being "integral".

The shell base 5 includes a sole portion 50, a toe reinforcement portion 51, and lateral portions 52 for foot retention. All of these demarcate a longitudinal opening 53 having sufficient width for the passage of the liner 6 and an inner cavity to house the liner. The shell base must be low enough in the instep area and also perhaps be punched so as to promote the flexibility provided by the liner in the front/rear direction and the entry of air for good ventilation around the foot. However, the shell base must not be too low to form a cavity with sufficient volume necessary to retain and protect a substantial part of the liner.

The shell base includes section reducing means 8 connecting the heel reinforcement portion 54 to the collar portion 7 so as to allow the collar to bend in at least one direction with respect to the heel reinforcement. Preferably, these section reducing means are positioned such that they promote any bending of the collar in a substantially longitudinal or front/rear direction while the collar opposes a resistance to bending for a lateral retention of the ankle. As shown, these section reducing means are, for example, notches 80 or 81 arranged in the region of the Achilles tendon, on the side between the collar portion and the shell base. However, in some circumstances, the favored bending direction can be substantially inclined with respect to the longitudinal direction of the boot.

The collar portion 7 is substantially U-shaped along a horizontal plane, and its opening is oriented towards the front in the direction of the toe of the shell base. This configuration promotes a good rear and lateral enveloping of the ankle. It also provides a certain elastic resistance when the leg bends towards the rear which is required to inform the skater about his reference position and balance. On the other hand, it allows greater flexibility when the leg bends towards the front so as to promote a certain freedom of movement while skating.

FIG. 5 illustrates the assembly operation of the liner in the shell base. The collar portion 7 passes through the pocket portion 60 of the liner that has the opening 67 provided to this end. The positioning is all the easier because the collar portion is integral with the rest of the shell base; this gives it a certain retention and stiffness during the enveloping process. Preferably, the pocket portion is long enough to cover and hide the section reducing means. One of the advantages is that the collar portion associated Lo the section reducing means can have different geometrical configurations without altering the external appearance of the boot. The pocket portion that covers the collar portion also makes the boot look like a flexible boot. The pocket connection also solves the connection problem between the collar and the flexible part of the boot, as can be the case in prior art documents. The pocket portion also forms a partial outer covering for the frame part, without a part of such covering being sandwiched between the mobile parts of the frame. Therefore, there is no risk of altering the covering part by wear and tear, as was the case in known prior art documents. A sliding contact surface is retained between the covered collar portion and the inside of the pocket, without requiring any additional connection, such as sewing, gluing or other connections. Another advantage lies in the possibility of making the liner detachable with respect to the shell base. Thus, the liner can be replaced, if necessary, or it can simply be provisionally separated for repair or drying. The liner can be connected to the shell base by additional connecting members, such as screws, rivets, or other equivalent elements. In a preferred embodiment, the boot is attached to the frame by the same affixing members as those used to affix the sole 61 of the liner in the shell base.

The pocket portion can be made of a flexible, traction-resistant and possibly stretchable material. This can be a fabric, leather, or a sheet of synthetic material.

The pocket portion is substantially U-shaped and open towards the front. It extends transversely, in a continuous manner, from one lateral side to the other and to the rear of the liner. The pocket portion is basically formed of a pliable and flexible main portion 600, and of an edge portion 601 that is more rigid and extends at least partially along the opening 67. The advantage of such a construction is that it helps keep the pocket portion pressed against the collar portion and prevents the edges of the pocket portion from turning over. Is also helps the assembly because it conserves the opening 67 and helps the sliding of the collar portion inside of the pocket portion.

In the embodiment described, the pocket portion 60 extends from the top of the collar portion or upper part 70 to a zone 71 located above the sole 50 of the shell base in the heel reinforcement region. For reasons of durability, it is preferable to leave the reinforcement portion without any covering of the flexible part because its surface is more resistant to the abrasions, frictions, and impacts than the pocket portion which is made of a more flexible material and is therefore more sensitive to such assaults.

The pocket portion has attachment elements 69 on the shell base. Preferably, an adequate number of such elements are distributed along the rigid edge 601. For example, these can be two in number, each located on one side of the shell base. Preferably, they are selected from among detachable elements so as to promote the detachability of die flexible part, the liner with respect to the rigid part, the shell base. These elements could be, for example, clips, screws, staples, buckles, and/or hook and loop fasteners, such as Velcro™. It is not necessary to provide a connecting element along the entire periphery of the edge 601, since the connection produced by the pocket is adequate in itself. The role of the connecting element is more of reducing the risk of the edge of the pocket portion from turning over and of keeping the edge pressed against the shell base.

The shell base can have an edge portion 710 forming an abutment for the correct positioning of the pocket portion 60 and for promoting die continuity of the surfaces between the flexible parts and the rigid parts of tie boot for reasons of appearance, finishing quality, and durability.

The lateral parts 52 of the shell base are extended, advantageously, via substantially rigid flaps 55 that border at least a portion of the longitudinal opening 53. The flaps are equipped with tightening elements 85 that work to contract the opening and limit the volume of the cavity around the liner. The relatively rigid flaps also help to retain the front of the liner, near the instep, in the shell base cavity. Their length and width can be variable depending on the requirements. Preferably, they are integral with the rest of the shell base and, preferably, molded all in one piece, i.e., unitarily, therewith.

Figure 6:
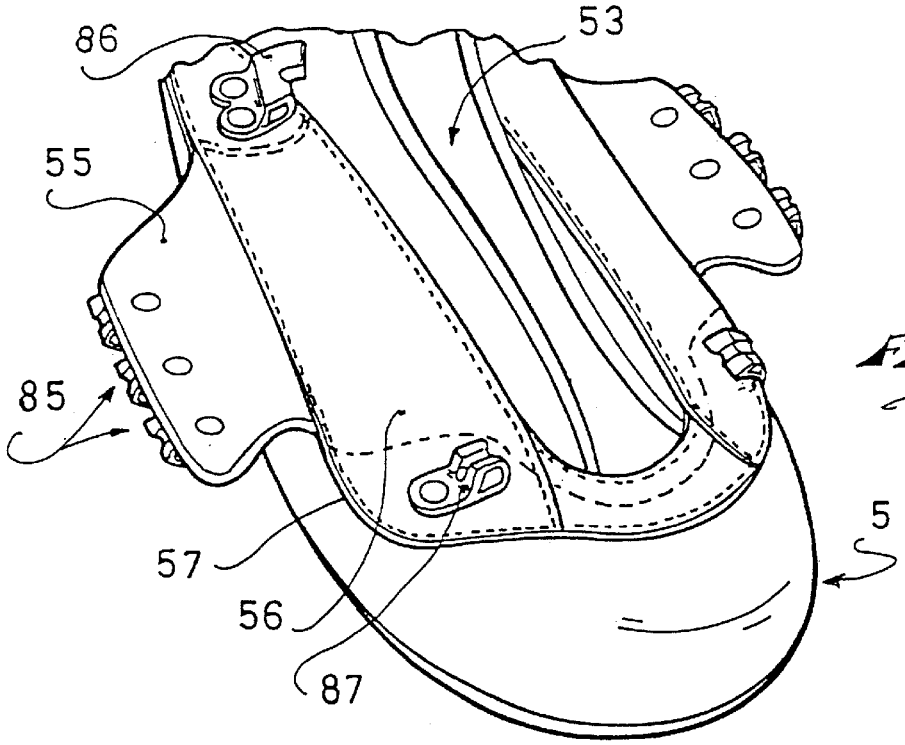
FIG. 6 is a detail of the vamp part of the boot according to the invention.

FIG. 6 shows a constructional detail of the boot according to the invention. In particular, a flexible and pliable protective strip 56 forms, at least partially, the edges of the opening 53 and is attached along at least a portion of the shell base 5. The strip 56 is relatively more flexible an the flaps 55. Preferably, the protective strip 56 can be used to line the inside of the flaps 55. The protective strip 56 is extended longitudinally beyond the flaps and also bears the tightening elements 86. 87. Its function is therefore to protect the liner from the direct supports of the rigid parts of the shell base, in particular the flaps 55, during tightening. Its role also includes providing comfort by avoiding hard spots on the liner. The strip 56 can be connected to the shell base via any appropriate connecting means, such as sewing, gluing, riveting, or any combination of such means.

Preferably, a flange 57 of the shell base is provided which borders the protective strip. The flange is thick enough in order for such flange to be flush with or slightly exceed the protective strip. The flange is used to protect the strip from abrasion. Preferably, the protective strip is obtained from a traction resistant flexible material, such as a fabric, a flexible plastic sheet, leather, etc.

The liner can also be equipped with tightening elements 88 in its top upper portion which act by tightening the upper part of the liner. This has the advantage of leaving the front of the top of the upper in a flexible and breathable material for better bending flexibility and good ventilation. All the tightening elements 85, 86, 87, and 88 are used to fully tighten the boot about the foot and the lower part of the leg. The tightening of the instep is mainly done via the tightening elements borne by the shell base, whereas the tightening of the lower part of the leg, above the ankle, is done via the elements borne by the liner. Such tightening elements can be return keepers, such as those represented, notched or self-gripping straps, hooks, buckles, etc. A tightening strap could also be added around the collar to ensure a better tightening of the ankle (not represented).

Figure 7:
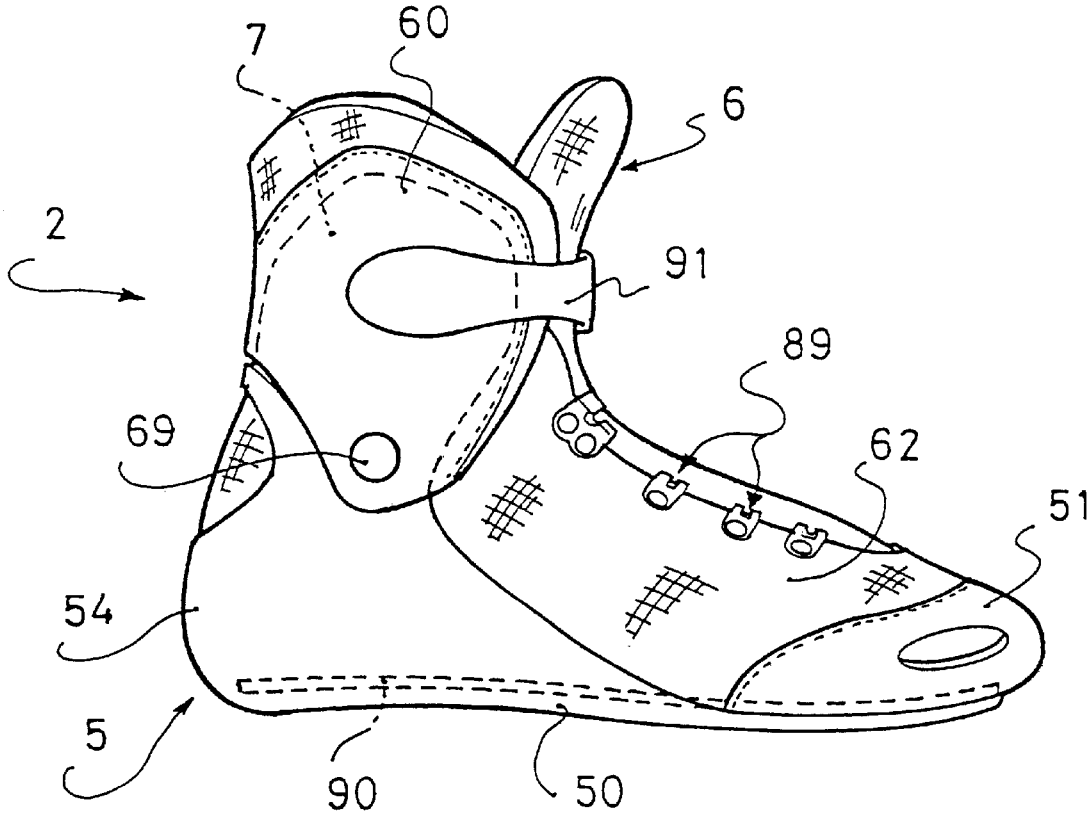
FIG. 7 is a side elevation view of a boot according to a variation of the invention.

FIG. 7 illustrates a possible variation of the boot 2 of the invention, in which the proportion of the shell base 5 is reduced with respect to the proportion of the flexible liner 6. The shell base has a sole 50 from which a heel reinforcement 54 extends. This assembly includes a cavity, open towards the front and acting as a receiving cradle for a flexible liner part. A collar 7, shown in broken lines, extends the heel reinforcement, preferably all in one piece, as was the case previously. The collar is covered by a pocket portion 60 of the liner It is advantageous for the heel reinforcement to not be covered by the pocket portion of the liner so as to retain greater flexibility and better resistance to abrasion in the lower part of the boot. The pocket portion is attached on each side of the shell base via a respective attachment element 69 that keeps the outer flexible lining pressed against the collar. The shell base also has a toe reinforcement 51 that is affixed to the liner before assembly and that therefore constitutes an element separate from the rest of the shell base before assembly. The liner has a flexible upper portion 62 made of a pliable, breathable and relatively resistant material, having a substantial part, preferably front and lateral, is left free so as to promote the lightness and breathability of the boot. The liner is tightened on the foot via tightening elements 89 that are assembled on the side of the liner. A tightening buckle 91 for the lower part of the leg can be mounted usefully on the collar to ensure its closure. The assembly of the liner on the shell base is done via an inner sole, called the "insole" 90 (represented in broken lines).

The method of assembly of the boot according to the invention includes:

assembling the liner 6 on the insole 90 via assembly elements by forming a sub-assembly;

assembling such liner/sole sub-assembly on the shell base 5 via other assembly elements.

The assembly elements can be selected from the group consisting of screws, glue, rivets, staples, and nails, for example.

Even though this may not be the best embodiment of the invention, one is obliged to envision, if necessary, a journal between the collar portion and the heel reinforcement portion. In such a case, the pocket portion will cover the journal from the outside so as to prevent any wear and tear problems and so as to hide this element, basically for a better retention of the liner with the shell base and also for reasons of appearance.

The invention can be envisioned for some applications in other types of sport boots having rising uppers, for example, for hiking boots, snowboarding boots, or ski boots when a type of light, economical and relatively flexible boot construction is desired along while ensuring retention for the foot and the lower part of the leg.

The invention is not restricted to the embodiment described hereinabove, but it encompasses numerous potential variations falling within the scope of the following claims.

The instant application is based upon the French priority patent application No. 98 04343, filed on Apr. 3, 1998, the disclosure of which is hereby expressly incorporated by reference thereto in its entirety, and the priority of which is hereby claimed under 35 USC 119.

What is claimed is:

1. A boot adapted to the practice of skating, comprising:

a shell base equipped with a rigid sole adapted to be attached on the frame of a skate, and a heel reinforcement part;

a flexible liner positioned inside said shell base comprising a padded upper part surrounding a skater's foot and at least one outer pocket portion fixed with respect to said upper part to create an opening between said upper part of said liner and said pocket portion, wherein the shell base comprises a rigid collar portion that extends the heel reinforcement, and the pocket portion at least partially covers the collar portion so as to ensure at least the partial retention of the flexible liner in the shell base when said liner is positioned inside said shell base.

2. A boot adapted to the practice of skating according to claim 1, wherein the pocket portion only partially covers the shell base so as to leave at least a substantial part of the heel reinforcement free.

3. A boot adapted to the practice of skating according to claim 1, wherein the collar portion is connected to the shell base all in one piece.

4. A boot adapted to the practice of skating according to claim 3, wherein the shell base comprises section reducing means connecting the heel reinforcement to the collar portion so as to allow the collar to bend along at least one preferred direction with respect to the heel reinforcement.

5. A boot adapted to the practice of skating according to claim 4, wherein the section reducing means are positioned in a way that allows a portion of the collar to bend in a substantially longitudinal direction whereas the collar portion opposes a resistance to bending for a lateral retention of the foot.

6. A boot adapted to the practice of skating according to claim 1, wherein the collar portion has a substantially U shaped section along a horizontal plane whose opening is oriented towards the front in the direction of the toe of the shell base.

7. A boot adapted to the practice of skating according to claim 1, wherein the outer pocket portion comprises an opening that is mainly oriented in a direction that helps said collar portion to slide in the pocket portion when the liner is inserted in the shell base.

8. A boot adapted to the practice of skating according to claim 7, wherein the opening of the pocket portion is oriented mainly downwardly in the direction of the sole.

9. A boot adapted to the practice of skating according to claim 7, wherein said pocket portion is mainly formed by a main pliable and flexible portion and a more rigid edge portion extending at least partially along the opening.

10. A boot adapted to the practice of skating according to claim 1, wherein the liner is mounted detachably in the shell base.

11. A boot adapted to the practice of skating according to claim 1, wherein the flexible liner comprises a sole portion connected to a portion of the flexible upper extending from the toe of the foot to the heel and that rises in the direction of the lower part of the leg.

12. A boot adapted to the practice of skating according to claim 1, wherein said shell base comprises a toe reinforcement part and lateral foot retention parts extending beyond the plane of the sole and demarcating a longitudinal opening, together with the sole and the heel reinforcement they form a receiving and retention cavity for a part of the liner.

13. A boot adapted to the practice of skating according to claim 12, wherein the lateral foot retention parts are extended via substantially rigid flaps that border at least a portion of the longitudinal opening, said flaps comprising tightening elements that are used to contract the longitudinal opening and limit the volume of the cavity around a part of said liner.

14. A boot adapted to the practice of skating according to claim 1, wherein said pocket portion extends from the top of the collar portion to a zone located above the sole of the shell base in the heel reinforcement region.

15. A boot adapted to the practice of skating according to claim 1, wherein said pocket portion comprises attachment elements on the shell base.

16. A boot adapted to the practice of skating according to claim 15, wherein the attachment elements on the shell base are located on either side of the shell base.

17. A boot adapted to the practice of skating according to claim 15, wherein the attachment elements are detachable elements, said elements comprising members selected from the group consisting of clips, screws, staples, buckles, and hook and loop fasteners.

18. An in-line skate equipped with a boot according to claim 1.

19. A method for manufacturing a boot adapted for the practice of skating comprising:

providing a flexible liner comprising a padded upper part and at least one flexible pocket portion fixed with respect to said upper part to create an opening between said upper part of said liner and said pocket portion;

manufacturing a rigid shell base separately from said liner, said shell base forming an open cavity and comprising a rigid sole, a reinforcement portion, at least a portion of the collar extending the shell base;

assembling said flexible liner to the shell base by introducing a part of the liner in said cavity and by threading at least a part of the collar portion through the opening between said upper part of said liner and said flexible pocket portion.

20. A method according to claim 19, wherein:

said opening of said flexible pocket portion of said flexible liner is downwardly facing.

21. A boot comprising:

a shell base comprising:

a rigid sole adapted to be attached onto a frame of a skate;

a heel reinforcement portion; and a rigid collar portion extending upwardly from said heel reinforcement portion;

a flexible liner positioned inside said shell base, said flexible liner comprising a flexible outer envelope, an inner padding within said flexible outer envelope and adapted to extend around a user's foot, and at least one flexible outer pocket portion affixed to said flexible outer envelope, an opening being formed between said flexible outer pocket portion and said flexible outer envelope;

said flexible outer pocket portion at least partially covering said rigid collar portion, with said rigid collar portion extending through said opening between said flexible outer pocket portion and said flexible outer envelope, when said liner is received within said shell base.

22. A boot according to claim 21, wherein:

said flexible liner further comprises a sole portion connected to a portion of said flexible outer envelope extending from a toe area to a heel area and rising in an upward direction of a lower part of a leg of a user.

23. A boot according to claim 21, wherein:

said flexible outer pocket portion comprises an edge portion extending at least partially along said opening between said flexible outer pocket portion and said flexible outer envelope.

24. A boot according to claim 21, wherein:

said flexible outer pocket portion extends from an area above an uppermost part of said rigid collar portion downwardly to an area spaced above said rigid sole of said shell base.

25. A boot according to claim 21, further comprising:

attachment elements for attaching said flexible outer pocket portion to said shell base.

26. A boot according to claim 25, wherein:

said attachment elements are positioned on opposite sides of said shell base.

27. A boot according to claim 21, wherein:

at least at an uppermost area of said flexible outer pocket portion, said flexible outer pocket portion is permanently affixed to said flexible outer envelope of said liner.

28. A boot comprising:

a relatively rigid shell base comprising a sole adapted to be attached onto a frame of a skate, a heel reinforcement portion, and a collar portion extending upwardly from said heel reinforcement portion adapted to rearwardly and laterally envelop an ankle of a user;

a relatively flexible liner positioned inside said shell base, said liner comprising:

an upper extending longitudinally from a toe area to a heel area and adapted to extend along opposite lateral sides and a rear of a lower leg of a user; and an outer pocket portion affixed to said upper of said liner;

wherein at least a part of said collar portion is positioned outside said upper of said liner and inside said pocket portion of said liner when said liner is positioned within said shell base.

29. A boot according to claim 28, wherein:

an opening is formed at a lower end of said outer pocket portion, said opening being situated between said upper of said liner and said outer pocket portion of said liner, said collar portion of said shell base extending through said opening and being at least partly covered by said outer pocket portion.

30. A boot according to claim 29, wherein:

said liner further comprises an inner padding within said upper of the liner.

31. An in-line roller skate comprising:

a frame and a plurality of wheels secured in longitudinal alignment to said frame;

a boot affixed to said frame, said boot comprising:

a shell base comprising a rigid sole affixed to said frame, a heel reinforcement portion, and a rigid collar portion extending upwardly from said heel reinforcement portion;

a flexible liner positioned inside said shell base, said flexible liner comprising a flexible outer envelope, an inner padding within said flexible outer envelope and adapted to extend around a user's foot, and at least one flexible outer pocket portion affixed to said flexible outer envelope, an opening being formed between said flexible outer pocket portion and said flexible outer envelope;

said flexible outer pocket portion at least partially covering said rigid collar portion, with said rigid collar portion extending through said opening between said flexible outer pocket portion and said flexible outer envelope when said liner is received within said shell base.

* * * * *